US005456231A

United States Patent [19]

Suzuki et al.

[11] Patent Number: 5,456,231

[45] Date of Patent: Oct. 10, 1995

[54] APPARATUS OF CONTROLLING INTAKE AIR THROTTLE VALVE FOR INTERNAL COMBUSTION ENGINE

[75] Inventors: Norio Suzuki; Yasuo Takagi; Yosuke Tachibana; Ritsuko Terawaki; Kazuo Hirabayashi, all of Wako, Japan

[73] Assignee: Honda Giken Kabushiki Kaisha, Tokyo, Japan

[21] Appl. No.: 189,299

[22] Filed: Feb. 1, 1994

[30] Foreign Application Priority Data

Feb. 5, 1993 [JP] Japan ..... 5-042032

[51] Int. Cl.[6] ..... F02D 41/04

[52] U.S. Cl. ..... 123/399

[58] Field of Search ..... 123/399, 361

[56] References Cited

U.S. PATENT DOCUMENTS 4,538,579 9/1985 Moriya et al. ..... 123/399 X

FOREIGN PATENT DOCUMENTS 56-14834 2/1981 Japan .

*Primary Examiner*—Tony M. Argenbright

*Attorney, Agent, or Firm*—Nikaido, Marmelstein, Murray & Oram

[57] ABSTRACT

An apparatus of controlling an intake air throttle valve capable of obtaining the certain drive for the change in the load applied to the throttle valve due to the change in the intake air amount in the transient period, without any increase in current consumption and reduction in responsiveness. The apparatus includes a throttle valve for controlling an intake air amount in the internal combustion engine; a motor for electrically controlling the throttle valve; and a drive circuit for controlling the drive torque of the motor. It further includes a throttle valve opening defining device for defining a parameter indicating the opening of the throttle valve; a comparing device for comparing the value of the parameter defined by the throttle valve opening defining device; and a torque increasing device for increasing the output torque by the drive circuit when the comparing device judges that the value of the parameter is larger than the specified value.

6 Claims, 6 Drawing Sheets

APPARATUS OF CONTROLLING INTAKE AIR THROTTLE VALVE FOR INTERNAL COMBUSTION ENGINE

BACKGROUND OF THE INVENTION

1. Field of the Invention

The present invention relates to a control of a motor for driving a throttle valve in an intake system of an internal combustion engine.

2. Description of the Related Art

In examples of using a step-motor for driving a throttle valve, there have been disposed various techniques of accurately performing the opening/closing of a throttle valve. For example, in Laid-Open Japanese Patent Publication No. SHO 56-14834, to cope with a problem that a spring for biasing a throttle valve on the closing side is increased in its biasing force linearly with the opening of the throttle valve, the drive frequency of a step-motor is reduced according to the opening of a throttle valve to obtain a suitable drive torque and retention of the stability.

The prior art technique described above can meet a load proportional to the opening of a throttle valve; however, it does not take any measure for a change in load in a transient period.

In particular, when a throttle valve is started to be open from the full-close state, a change in intake-air amount is transiently increased, which acts as a dynamic friction to the throttle valve.

As a consequence, when a load is largely changed in a transient period, a torque for turning a throttle valve becomes insufficient, and the desirable valve-opening drive cannot be obtained, so that there is the fear of causing the out-of-phase in a step-motor or the like.

A method may be considered to usually drive a motor with a torque corresponding to the change in load in a transient period; however, it increases current consumption thereby deteriorating responsiveness.

SUMMARY OF THE INVENTION

Taking the above circumstances into consideration, the present invention has been made, and its object is to provide a control apparatus capable of realizing the accurate drive of a throttle valve according to a change in load in a transient period without any increase in current consumption and any reduction in responsiveness.

To achieve the above object, according to the present invention, there is provided an apparatus of controlling an intake air throttle valve for an internal combustion engine, comprising: a throttle valve for controlling an intake air amount in the internal combustion engine; a motor for electrically controlling the throttle valve; and a drive circuit for controlling the drive torque of the motor. The apparatus further comprises: a throttle valve opening defining means for defining a parameter indicating the opening of the throttle valve; a comparing means for comparing the value of the parameter defined by the throttle valve opening defining means with a specified value; and a torque increasing means for increasing the output torque of the motor by the drive circuit when the comparing means judges that the value of the parameter is larger than the specified value.

When the value of the parameter indicating the opening of the throttle valve is judged by the comparing means to be larger than the specified value defined according to a change in the load applied to the throttle valve, the torque of turning the throttle valve tends to be insufficient due to a large change in load, and accordingly, the torque is increased, to thereby ensure the certain drive of the throttle valve.

Since the throttle valve is not usually driven with a large torque, it is possible to prevent the increase in current consumption and the reduction in responsiveness.

Even if the torque is possibly insufficient due to a change in the load applied to a throttle valve, when the voltage applied to a motor is low, the drive of the throttle valve to obtain a large opening is prohibited for keeping the normal drive control condition of the throttle valve.

DETAILED DESCRIPTION OF THE PREFERRED EMBODIMENTS

One embodiment of the present invention will be described with reference to FIGS. 1 to 5.

Figure 1:
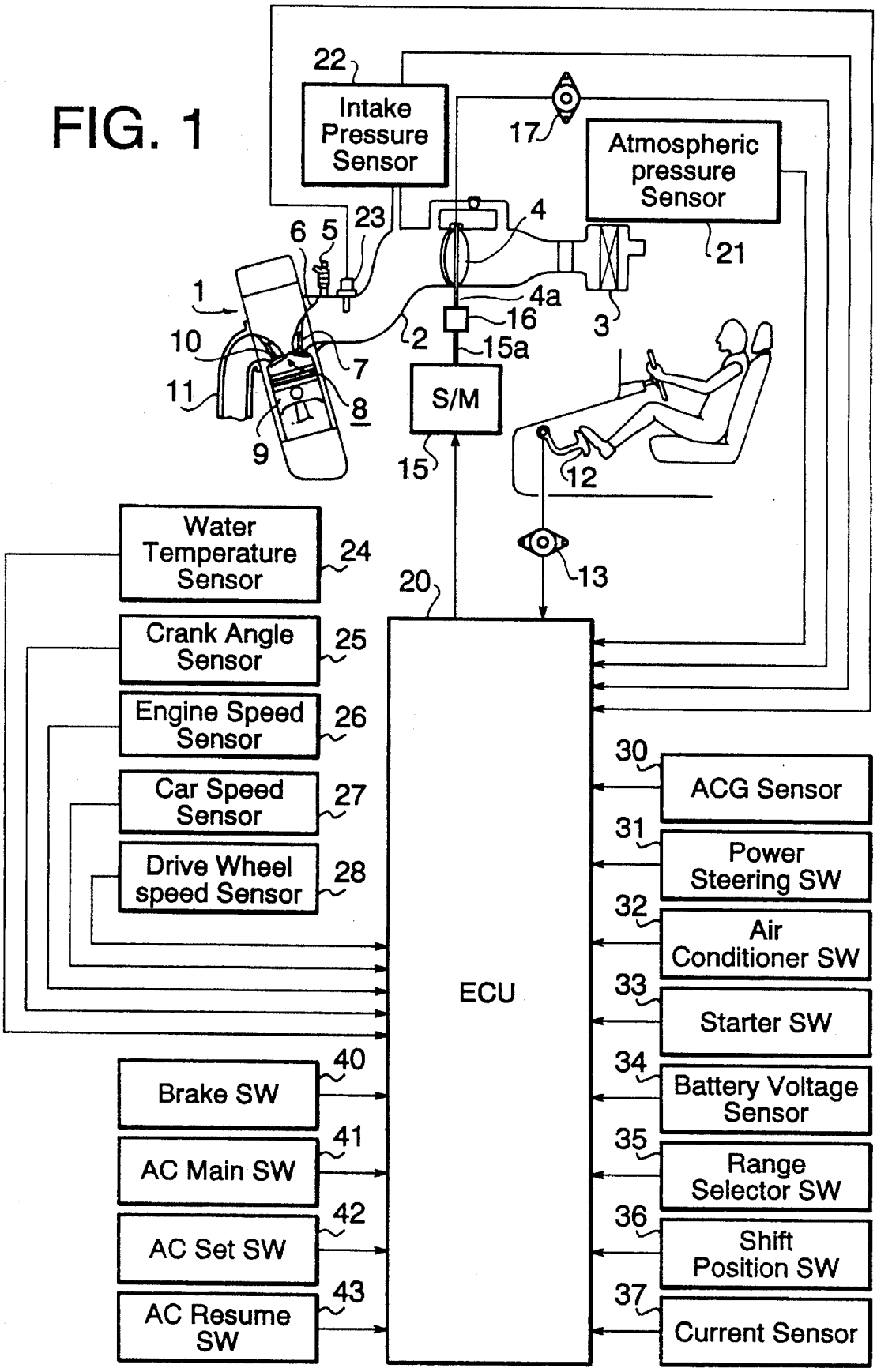
FIG. 1 is a schematic view showing the whole construction of an apparatus of controlling the fuel supply in an internal combustion engine according to one embodiment of the present invention.

FIG. 1 is a schematic view showing the whole construction of an apparatus of controlling the fuel supply in an internal combustion engine mounted in a vehicle according to this embodiment.

In an intake passage 2 for supplying a fuel in an internal combustion engine 1, an air cleaner 3 is provided at the end of the upstream side; a throttle valve 4 is disposed in the midway to freely open/close the intake passage 2; and a fuel injection valve 5 is provided on the downstream. An air introduced in the intake passage 2 through the air cleaner 3 is adjusted in its flow rate by the throttle valve 4, entering an intake manifold 6, and flows in a combustion chamber 8 through an intake port opened/closed by an intake valve 7 together with the fuel injected by the fuel injection valve 5.

The resultant air-fuel mixture is burned to drive a piston 9, passing through an exhaust port opened/closed by an exhaust valve 10, and is discharged from an exhausted manifold 11 to the outside of the engine through an exhaust passage.

An accelerator 12 is disposed on the floor surface of an operator room in a vehicle mounting the internal combustion engine 1, and which is biased at the full-close position by a spring and rocked according to the step-in action of an operator.

As shown in FIG. 1, the accelerator 12 is not mechanically connected to the throttle valve 4. Namely, the step-in amount of the accelerator 12 is detected by an accelerator sensor 13 composed of a potentiometer provided on a rocking shaft of the accelerator 12, and the throttle valve 4 is driven to be opened/closed by a step-motor 15. The step-motor 15 is operated on the base of a drive signal from an electronic control unit ECU 20.

A drive shaft 15a of the step-motor 15 is coaxial with a valve shaft 4a of the throttle valve 4, and is directly connected therewith by means of a connecting portion 16, without any speed change device such as a gear.

The normal and reverse rotational angle of the step-motor 15 directly constitute the opening and closing angle of the throttle valve 4, respectively.

The opening/closing angle of the throttle valve 4 is detected by a throttle sensor composed of a potentiometer or the like. The detection signal from the throttle sensor 17 is inputted in the ECU 20.

In the intake passage 2, an atmospheric pressure sensor 21 is disposed on the upstream side; an intake pressure sensor 22 for detecting an absolute pressure of an intake air is provided on the downstream side of the throttle valve 4; and an intake temperature sensor 23 for detecting the temperature of an intake air is disposed on the downstream side of the intake pressure sensor 22.

A water temperature sensor 24 for detecting a cooling water temperature is provided at a suitable position in the vicinity of the combustion chamber 8 of the internal combustion engine 1; a crank angle sensor 25 is provided in a distributor; and an engine speed sensor 26, car speed sensor 27 and a drive wheel speed sensor 28 are provided at suitable positions. A detection signal from each of the above sensors is inputted in the ECU 20.

Moreover, in the control apparatus of this embodiment, there are provided an ACG sensor 30 for detecting a field current of an alternator; a power steering switch 31 for detecting the presence or absence of the action of a power steering; an air conditioner switch 32 for detecting the presence or absence of the action of an air conditioner; a starter switch 33 for detecting the presence or absence of the action of a starter; a battery voltage sensor 34 for detecting a battery voltage; a range selector switch 35 for detecting the range position of a shift lever; and a shift position sensor 36 for detecting a shift position. A detection signal from each of the above sensors is inputted in the ECU 20. Additionally, a current sensor 37 composed of a Hall element is disposed on a main electric wire extending from a battery for detecting an electric load. A detection signal from the current sensor 37 is also inputted in the ECU 20.

Moreover, for auto-cruise (AC) control, there are provided a brake switch 40, an AC main switch 41, an AC set switch 42 and an AC resume switch 43.

Here, the step-motor 15 is of a hybrid four-phase stepping type, and is driven by a two-phase exciting drive system.

The step-motor 15 can be usually driven both in a two-phase drive mode, and in a micro-step drive for performing high resolution without mechanical reduction. The two drive modes, the two-phase mode and micro-step mode, can be freely selected using software.

In the two-phase mode, there is adopted a usual drive method for supplying the substantially similar drive currents to the adjacent exciting phases, and in this embodiment, the step-motor is rotated by 1.8° on the base of one step.

On the other hand, in the micro-step mode, there is adopted a drive method for supplying drive currents with different duties to the adjacent exciting phases, and a further small rotational angle obtained by dividing the one step (1.8°) in the two-phase mode by a duty ratio is taken as the rotational angle for one step. In this embodiment, the angle of 1.11° obtained by dividing the angle of 1.8° by 16 is taken as a unit of the rotational angle, and may be further finely divided.

The rotational speed of the step-motor 15 is proportional to a drive frequency f (pps).

As the drive frequency <f> is larger, the rotational speed is increased with high responsiveness; but the drive torque is made smaller.

On the contrary, as the drive frequency <f> is smaller, responsiveness is lowered; but the drive torque is made larger.

In this embodiment, the drive frequency <f> is selected from two kinds of the frequencies of 600 pps ($TM_{OH}$) and 400 pps ($TM_{OL}$), and may be finely selected according to the desired rotational speed and the desired drive torque.

In addition, in relation to the digital processing by an computer, the throttle opening and the rotational speed are represented by the number of the steps on the base of the hexadecimal number system using a memory of 10 bits.

The lower four figures of 10 bits (lower one figure in the hexadecimal number system) are equivalent to the micro-step mode, and the higher figures than the above figures are equivalent to the two-phase mode.

Accordingly, $10_H$, in the hexadecimal number system ($_H$ is the abbreviation of the hexadecimal number system) is equivalent to one step, that is, the rotational angle of 1.8° in the two-phase mode, and the angle less than $OF_H$ (unit: $01_H$) obtained by dividing $10_H$ by 16 is equivalent to one step in the micro-step mode.

The exciting phases has four kinds of the combinations; fourth phase×first phase, first phase×second phase, second phase×third phase, and third phase×fourth phase. Since there are 16 pieces of duty patterns for each exciting phase in the micro-step mode, there are 64 kinds of the exciting patterns as a whole, and the number of steps less than $40_H$ correspond to each of 64 kinds of the exciting patterns.

On the other hand, the drive of the step-motor 15 with the two-phase mode is changed in its duty ratio between the drive state and hold state of the throttle valve. The drive duty $DM_{OV}$ of the former is smaller than the hold duty $D_{HLD}$ Of the latter.

Hereinafter, a procedure for the drive control in the step-motor 15 will be described with reference to flow-charts shown in FIGS. 2 to 5.

Figure 2:
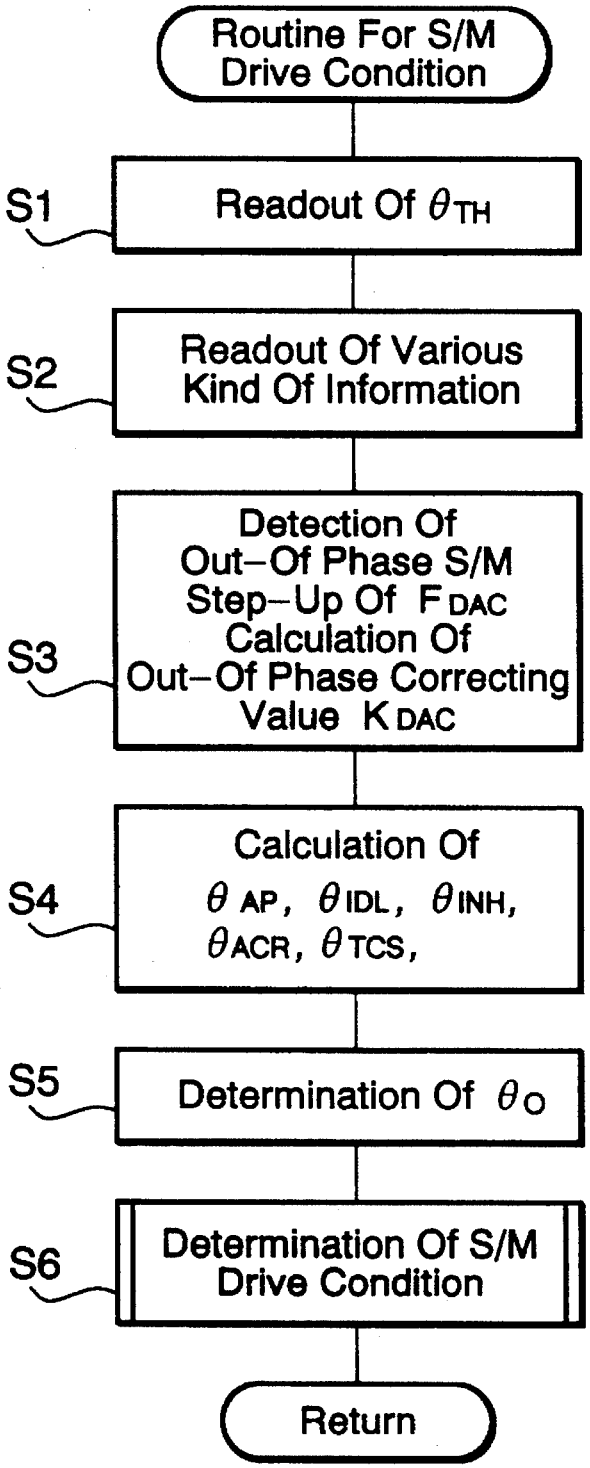
FIG. 2 is a flow chart showing a control procedure of a routine for a step-motor drive condition in a control system of the apparatus of FIG. 1.
Figure 3:
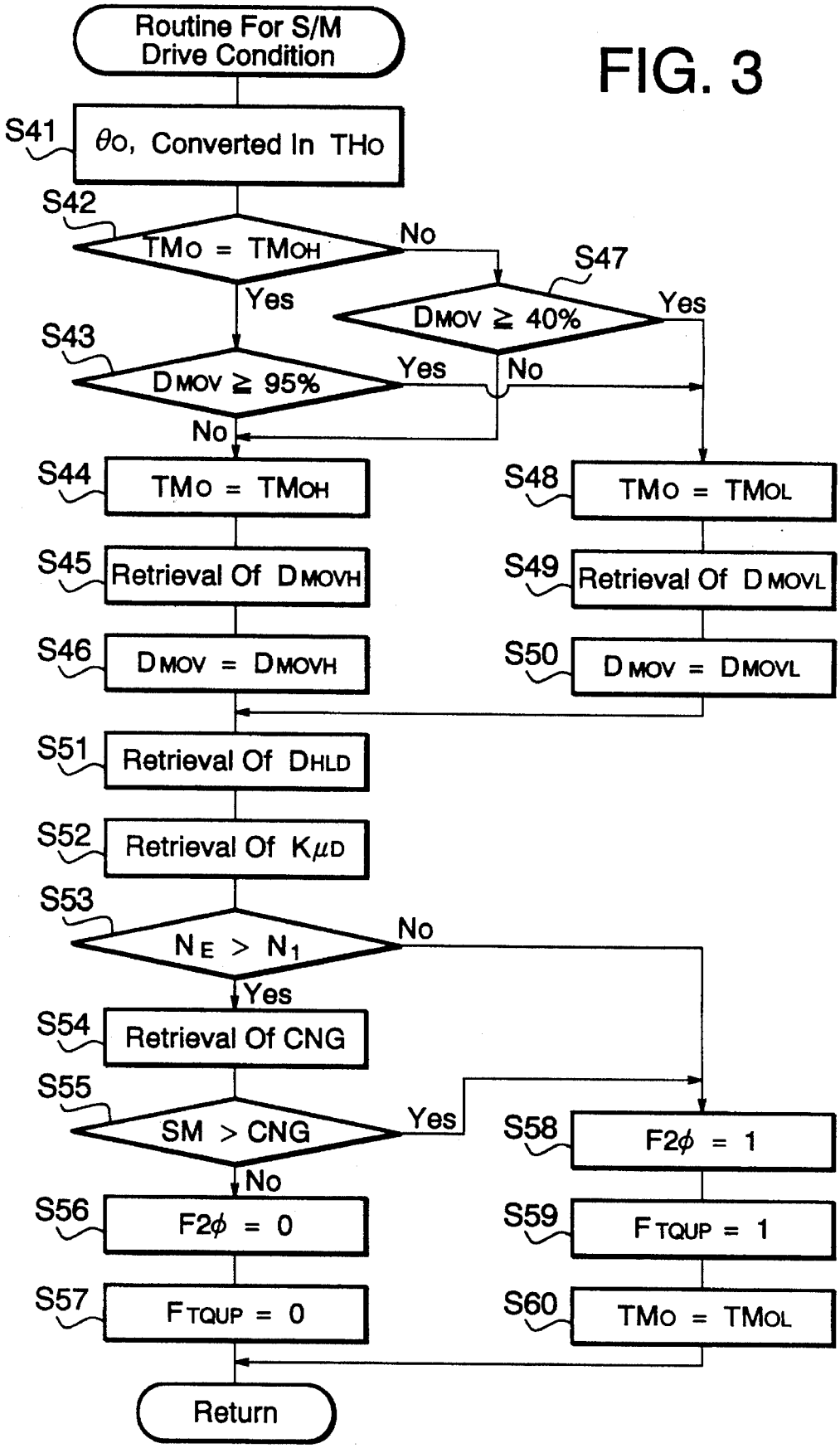
FIG. 3 is a flow chart showing a routine for determining the step-motor drive condition.
Figure 4:
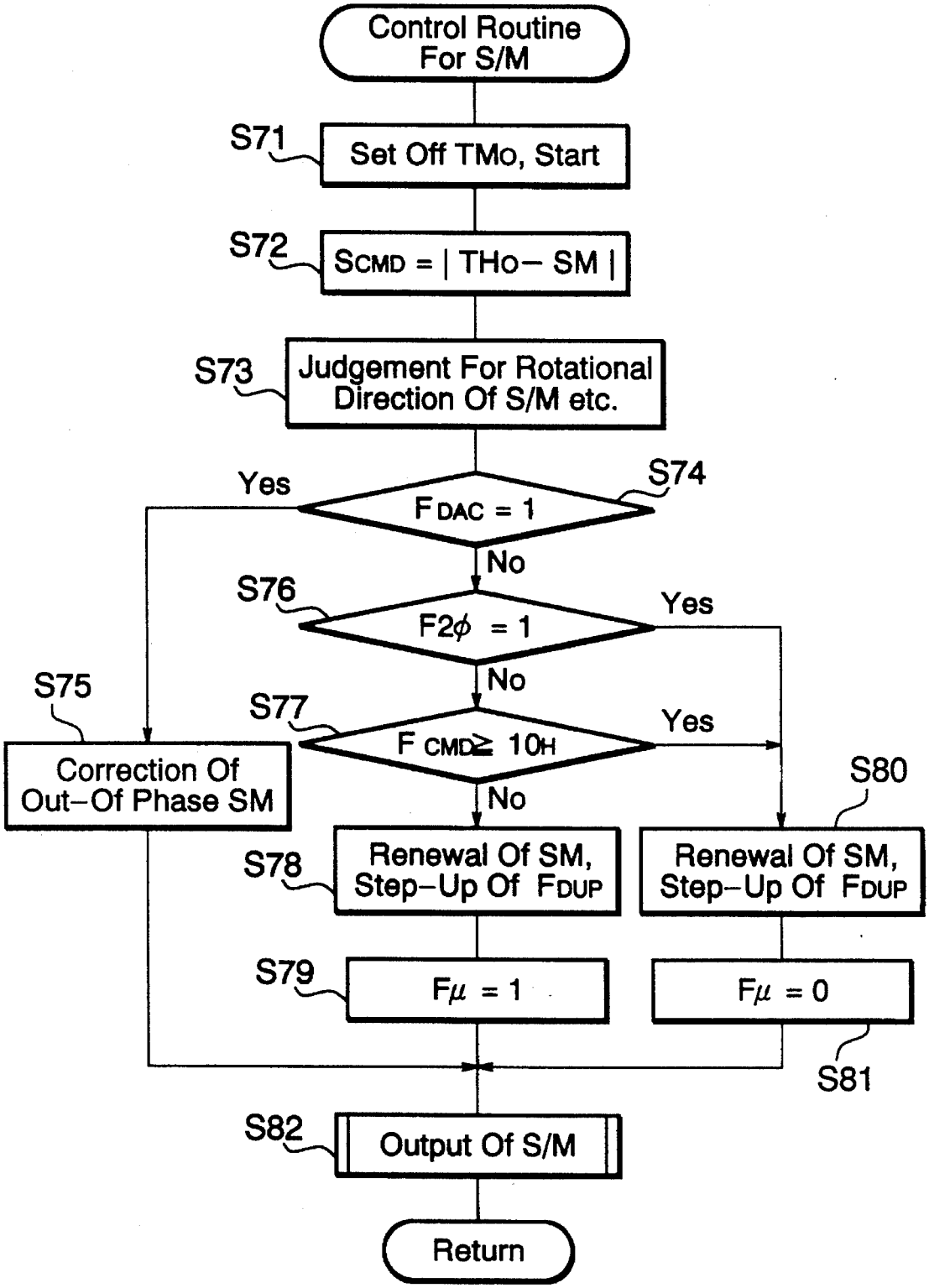
FIG. 4 is a flow chart showing a routine for controlling the step-motor.
Figure 5:
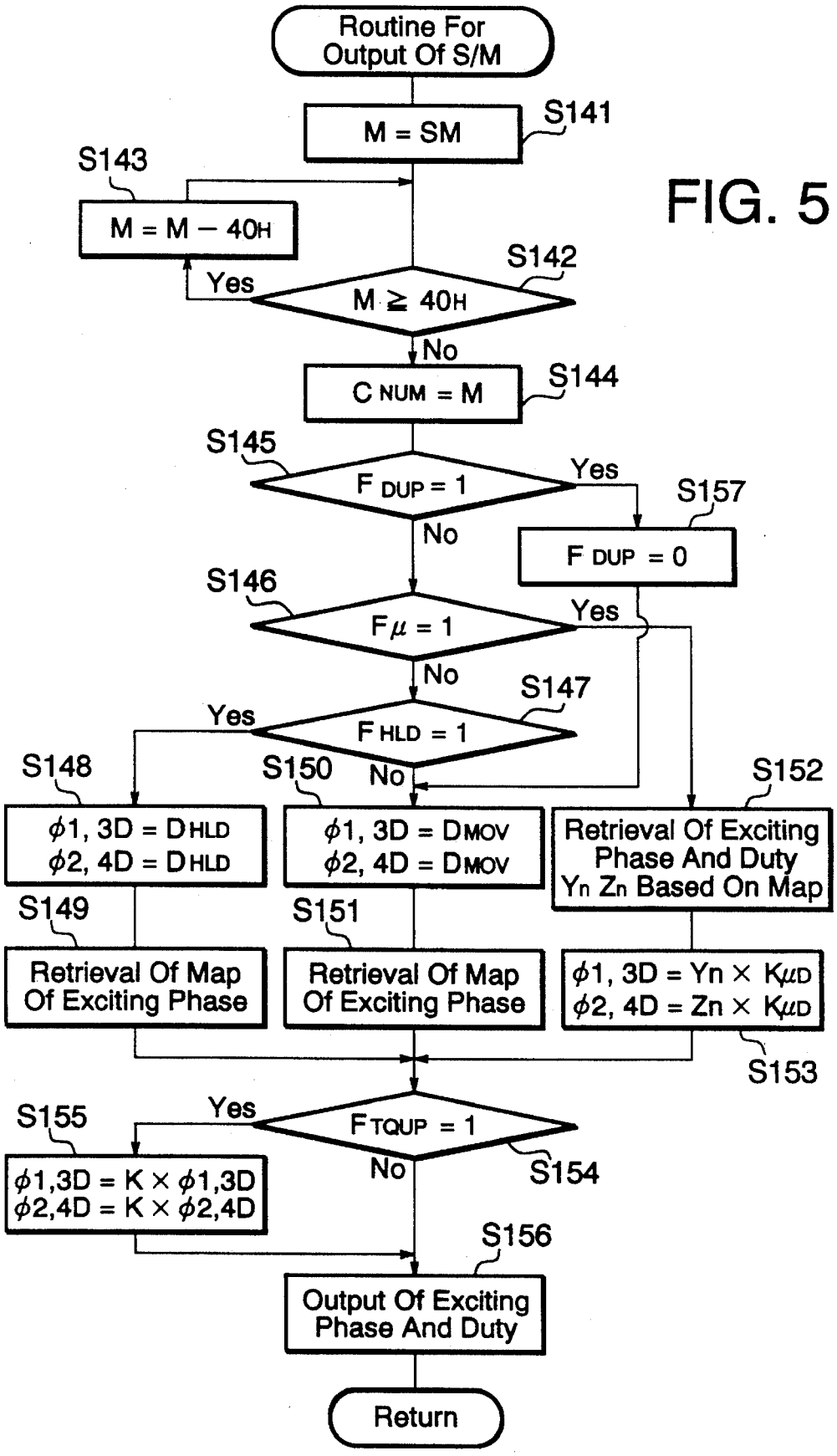
FIG. 5 is a flow chart showing a routine for the output of the step-motor.

The flow-charts are mainly selected into two kinds of a routine for setting the drive condition of the step-motor 15 (FIG. 2 is a main routine and FIG. 3 is a sub-routine), and a routine for actually controlling the step-motor 15 (FIG. 4 is a main routine and FIG. 5 is a sub-routine).

The routine for a step-motor drive condition shown in FIG. 2 is executed by the interruption with 10 msec. First, a throttle opening $\theta_{TH}$ detected by the throttle sensor 17 is read out (step 1), and also the detection information from various sensors such as an step-in amount AP of the accelerator 13 is read out (step 2).

The process advances to the step 3, wherein the out-of-phase of the step-motor is detected.

The out-of-phase of the step-motor 15 means the difference between the present position stored by the control system of the step-motor and the actual motor position. The difference is usually generated between the different positions having the same exciting phase.

In this embodiment, the out-of-phase is judged to be generated in the case that the deviation between a present throttle opening SM stored by the control system of the throttle valve 4 and a throttle opening TH ($\theta_{TH}$ is converted into the number of steps) detected by the throttle sensor 17 is more than a specified value.

In the step for detecting the , out-of-phase, when the out-of-phase is detected, a out-of-phase flag $F_{DAC}$ becomes [1]and a out-of-phase correction value $K_{DAC}$ is calculated on the base of this deviation.

In the subsequent step 4, each target throttle opening value is calculated.

Namely, from respective operating conditions, there are calculated a usual throttle opening $\theta_{AP}$ corresponding to a step-in amount AP of the accelerator 12, a throttle opening $\theta_{ACR}$ in auto-crew, a throttle opening $\theta_{IDL}$ in idling, a throttle opening $\theta_{TCS}$ in traction control, and a throttle opening $\theta_{INH}$ in restriction of the engine output.

From five kinds of throttle openings $\theta_{AP}$, $\theta_{IDL}$, $\theta_{INH}$, $\theta_{ACR}$, and $\theta_{TCS}$, the final target throttle opening $\theta_O$ is determined in the subsequent step 5.

In the next step 6, the step-motor drive condition is determined on the base of the target throttle opening $\theta_O$ The routine for determining the step-motor drive condition will be described with reference to a flow-chart shown in FIG. 3.

First, the target throttle opening $\theta_O$ determined by the above step 5 is converted into the number THo of steps of the step-motor 15 (step 41), and the process advances to the step 42, In the step 42, it is judged whether or not the present drive frequency TMo (interrupted timer set-up value in drive control of the step-motor) of the step-motor is the higher value, that is, 600 pps ($TM_{OH}$). When it is $TM_{OH}$, in the step 43, it is judged whether or not the present drive duty $D_{MOV}$ is an upper limit value (for example, 95%) or more. When it is less than the upper limit value (for example, 95%), in the step 44, $TM_O$ is set at 600 pps being the higher drive frequency $TM_{OH}$ again. When $D_{MOV}$ is the upper limit value (for example, 95%) or more, the process advances to the step 48, wherein $TM_O$ is set at 400 pps being the lower drive frequency $TM_{OL}$.

On the other hand, when the present drive frequency $TM_O$ is not $TM_{OH}$, that is, $TM_{OL}$ in the step 42, the process advances to the step 47. In the step 47, it is judged whether or not the drive duty $DM_{OV}$ is the lower limit value (for example, 40%) or more. When it is less than the lower limit value (for example, 40%), the process advances to the above step 44, wherein the drive frequency TMo is set at 600 pps being the higher drive frequency $TM_{OH}$. When it is more than the lower limit value (for example, 40%), the process advances to the step 48, wherein the drive frequency $TM_O$ is set at 400 pps being the lower drive frequency $TM_{OL}$ again.

As described above, in the case that the drive frequency $TM_O$ is the higher value of $TM_{OH}$ (600 pps), when the drive duty $DM_{OV}$ is the upper limit value (for example, 95%) or more, the step-motor 15 is susceptible to the influence of the change in power voltage due to the variation in the electric load. Accordingly, the drive frequency is reduced to be the lower value of $TM_{OL}$ (400 pps), which makes it possible to ensure the drive is the lower value of $TM_{OL}$ (400 pps), when the drive duty $D_{MOV}$ is torque enough to accurately drive the step-motor 15.

On the contrary, in the case that the drive frequency less than the lower limit value (for example, 40%), the drive frequency is increased up to the higher value of $TM_{OH}$ (600 pps), which makes it possible to enhance the responsiveness while keeping the sufficient drive torque.

Further, when the drive frequency $TM_O$ is set at the higher drive frequency $TM_{OH}$ in the step 44, the process advances to the subsequent step 45. In the step 45, the drive duty table for $TM_{OH}$ is retrieved to select the value of $D_{MOVH}$ corresponding to a battery voltage $V_B$. Thus the drive duty $D_{MOV}$ is set at the value of $D_{MOVH}$ (step 46).

Moreover, when the drive frequency $TM_O$ is set at the lower drive frequency $TM_{OL}$ in the step 48, the process advances to the subsequent step 49. In the step 49, the drive duty table for $TM_{OL}$ is retrieved to select the value of $D_{MOVL}$ corresponding to the battery voltage $V_B$. Thus the drive duty $D_{MOV}$ is set at the value of $D_{MOVL}$ (step 50).

After the drive duty $D_{MOV}$ is thus set at the value of $D_{MOVL}$, a hold duty $D_{HLD}$ is, in the step 51, retrieved according to the battery voltage $V_B$ from a hold duty table.

Further, in the step 52, a duty correction coefficient $K_{\mu D}$ based on the battery voltage $V_B$ in the micro-step is retrieved from the table.

Thus, the four step-motor drive conditions of the drive frequency $T_{MO}$, drive duty $D_{MOV}$, hold duty $D_{HLD}$ and duty correction coefficient $K_{\mu D}$ are determined.

Next, in the step 53, it is judged whether or not an engine speed $N_E$ is a specified speed $N_1$ or less. When it is less than the value of $N_1$, the engine is not perfectly started, and accordingly, the process is jumped to the step 58 for taking a measure for current consumption. In the step 58, to forcibly make the mode of the step-motor in the two-step drive mode, a forcible two-phase flag F2ϕ is set at [1], to thus indicate the two-phase drive mode.

When the engine speed $N_E$ exceed the value of $N_1$ in the step 53, the process advances the step 54 for performing the table retrieval for a specified value of CNG.

In this embodiment, the specified value of CNG is a throttle opening value predetermined according to the engine speed Ne, and is a variable to be changed on a small opening side when the engine speed is low. The specified value CNG thus retrieved is a threshold value in which, when the throttle valve is opened from a lower opening (in the vicinity of the idling opening), the variation in the intake air amount generated along with the change in the opening of the throttle valve is made larger and the throttle valve is estimated to be applied with a large load.

Accordingly, when the stored throttle opening SM is smaller than a specified value of CNG, the forcible two-phase flag F2ϕ is set at [0] (step 56) and a torque-up flag $F_{TQUP}$ is also set at [0] (step 57). When the stored throttle opening SM is in the relation of SM>CNG while the two-phase drive and the torque-up are not indicated, the process is jumped from the step 55 to the step 58, wherein the forcible two-phase flag F2ϕ is set at [1], and the torque-up flag $F_{TQUP}$ is set at [1] (step 59). Subsequently, the drive frequency $TM_O$ is set at the lower drive frequency $TM_{OL}$ (step 60).

Next, a procedure for actually controlling the drive of the step-motor 15 under the condition set in the manner described above will be described with reference to FIGS. 4 and 5.

First, in the main routine for the control of the step-motor shown in FIG. 4, in the step 71, the drive frequency $TM_O$ determined as described above is set, and thereafter the main routine is acted with the interrupted period based on the same drive frequency $TM_O$.

Then, in the step 72, the absolute value of the difference between the step position $TH_o$ of the target throttle opening and the step position SM of the present stored throttle opening is taken as a target number $S_{CMD}$ of steps, and in the step 73, the rotational direction of the step-motor 15 is judged.

In the step 74, the state of the out-of-phase flag $F_{DAC}$ is judged. When the flag is set at [1], the process advances to the step 75, wherein the stored throttle opening SM is corrected on the base of the above out-of-phase correction coefficient $K_{DAC}$, and the process advances to the step 82.

In the step 74, when the out-of-phase flag $F_{DAC}$ is set at [0], the step-motor is not in the out-of-phase state, and the process advances to the step 76, wherein it is judged whether or not the forcible two-phase flag F2ϕ is set at [1]. When it is set at [1], the process advances to the step 80. When F2ϕ=0, the process advances to the step 77, wherein it is judged whether or not the number $S_{CMD}$ of the target step is $10_H$ or more.

When the number $S_{CMD}$ of the target step number $S_{CMD}$ is $10_H$ or more, the process advances to the step 80, whereas when it is less than $10_H$, the process advances to the step 78.

Namely, when the process advances to the step 80, the step-motor is in the present two-phase mode is set, and in the case that the forcible two-phase flag F2ϕ is set as [1] and the number of the target step is $10_H$ or more, the process advances to the step 80. On the contrary, in the case of F2ϕ=0 and $S_{CMD}<10_H$, the process advances to the step 78 for driving the step-motor with the micro-step mode.

Since the step-motor is in the two-phase mode, the stored throttle opening SM is renewed on the base of the present two-phase mode and the previous state Further, when it is judged that the duty-up is necessary, the duty-up flag $F_{DUP}$ is set at [1].

The duty-up flag $F_{DUP}$ functions as follows; namely, in the case of the reverse drive with the two-phase mode, when the step-motor is shifted from the drive state to the hold state and is also shifted from the two-phase drive to the micro-step drive, a large drive duty is set to suppress vibration for preventing the out-of-phase Then, in the subsequent step 81, the micro-step flag Fμ is set at [0], and the process advances to the step 82.

On the other hand, since the step-motor is in the micro-step mode, the process advances to the step 78. In the step 78, the stored throttle opening SM is renewed and the duty-up flag $F_{DUP}$ is set on the base of state of the present micro-step mode and the state of the previous state, and the micro-step flag Fμ is set at [1]. Thus, the process advances to the step 82.

As described above, when the process advances to the step 88 after renewal of the stored throttle opening, the process enters the routine for the output of the step-motor.

The above output routine is shown in FIG. 5. First, in the step 141, the stored throttle opening SM after renewal is temporarily stored at the store value M, and then it is judged whether or not the stored value M is $40_H$ or more (step 142). When it is $40_H$, or more, the process advances to the step 143, wherein the new stored value M is obtained by subtracting the value of $40_H$ from the stored value M, to obtain the new stored value. Then the process is returned into the step 142, wherein it is judged whether or not the stored value M thus calculated is $40_H$ or more.

By repeating the steps 142 and 143, the value which is residual after dividing the original stored value M by $40_H$ is taken as the new stored value M. When there is generated the residual, the process advances from the step 142 to the step 144, wherein a counter value $C_{NUM}$ for determining the exciting phase and the like is set at the residual stored value M.

The counter value $C_{NUM}$ lies between $00_H$ and $3_{FH}$ (0–63). By the map retrieval on the base of the counter value $C_{NUM}$, it is possible to determine the exciting phase of the step-motor 15 to be subsequently excited, and in the case of the micro-step mode, the duty of the adjacent exciting phase is also determined by the map retrieval.

After the counter value $C_{NUM}$ is set, in the step 145, the state of the duty-up flag $F_{DUP}$ is judged. When $F_{DUP}$=1, the duty-up flag $F_{DUP}$ is returned to [0] in the step 157, and the process is jumped to the step 150. When FDUP=0 in the step 150, in the subsequent step 146, it is judged whether or not the micro-step flag Fμ is set at [1]. When the step-motor is in the micro-step mode (Fμ=1), the process advances to the step 152, wherein the drive control for the micro-step mode is set. On the other hand, when it is in the two-step mode (Fμ=0), the process advances to the step 147, wherein it is judged whether or not the hold-indication is present on the base of the hold-flag $F_{HLD}$. When the hold-indication is present ($F_{HLD}$=1), the process advances to the step 148, wherein the two-phase state is set. On the other hand, when the drive indication is present ($F_{HLD}$=0), the process advances to the step 150, wherein the two-phase drive state is set.

Namely, not in the duty-up indication ($F_{DUP}$=0), in the two-phase mode (Fμ=0) and in the hold indication ($F_{HLD}$=1), the process advances to the step 148. In the step 148, chopping duties ϕ1,3D and ϕ2,4D of the exciting currents in the first or third phase and the second or fourth phase of the step-motor 15 are set at the hold duty value $D_{HLD}$, and in the subsequent step 149, the exciting phase is determined by the map retrieval on the base of the above counter value $C_{NUM}$.

Further, not in the duty-up indication ($F_{DUP}$=0), in the two-phase mode (Fμ=0) and in the drive indication ($F_{HLD}$=1), the process advances to the step 150. In the step 150, the chopping duties ϕ1,3D or ϕ2,4D of the exciting currents in the first or third phase and the second or fourth phase of the step-motor 15 is set at the hold duty value $D_{MOV}$, and in the subsequent step 151, the exciting phase is determined by the map retrieval on the base of the above counter value $C_{NUM}$.

Here, the duty value $D_{MOV}$ is naturally larger than the hold duty value $D_{HLD}$ because the drive torque can be ensured even when the duty value is smaller at the time of the hold-state.

Consequently, when the duty-up indication is present ($F_{DUP}$ =1), the process is jumped to the step 150 by way of the step 148, so that the chopping duty ϕ1,3D or ϕ2,4D is set at a large drive duty value $D_{MOV}$.

Namely, the chopping duty for the exciting current is set at the large drive duty value $D_{MOV}$ to suppress vibration for preventing the step-out.

When the micro-step mode is indicated (Fμ=1), the process advances from the step 146 to the step 152, wherein the exciting phase and the duty Yn (first or third phase duty) and Zn (second or fourth duty) in the micro-step mode are subjected to the map retrieval on the base of the counter value $C_{NUM}$.

In the subsequent step 153, the duties Yn and Zn are multiplied by the duty correction coefficient KμD obtained on the base of the battery voltage VB in the above step 52 (FIG. 3), so that the first or third and the second or fourth chopping duties ϕ1,3D or ϕ2,4D are set at the values thus obtained, respectively.

After the exciting phases and the duty of each exciting phase in the two-phase drive or the micro-step drive are set, the process further advances to the step 154. In the step 154, it is judged whether or not the torque-up flag FTQUP is set at [1]. When it is [0], the process advances to the step 156, wherein the drive control signal is outputted to the step-motor 15 to drive the step-motor 15 under the above setting condition. On the contrary, when $F_{TQUP}$=1, the process advances to the step 155, wherein the chopping duties ϕ1,3D or ϕ2,4D set as described above are multiplied by a constant K more larger than 1 to obtain new chopping duties ϕ1,3D or ϕ2,4D, and the process advances to the step 156 for outputting this drive control signal to the step-motor 15 for driving it.

As described, in this embodiment, in the case that is expected that the change in the load applied to the throttle valve is larger so that the present stored throttle opening SM exceeds the threshold value CNG determined by the engine speed $N_E$; the torque-up flag $F_{TQUP}$ is set at [1] (step 59); the drive frequency $T_{MO}$ is set at the lower frequency (step 60) and the chopping duties ϕ1,3D and ϕ2,4D are corrected to be large values (step 155) so as to enlarge the torque for driving or holding the throttle valve, thereby preventing the out-of-phase for ensuring the accurate drive of the throttle valve.

This eliminates the necessity of usually keeping the torque, and makes it possible to reduce current consumption, and to suppress the delay of responsiveness at minimum.

In the embodiment described above, the specified value CNG is determined on the base of the engine speed $N_E$; however, it may be a variably changed according to the intake tube pressure $P_B$ detected by the intake pressure sensor 22 or to the change amount thereof $\Delta Q_A$ and $\Delta P_B$.

When the intake air amount $Q_A$ is largely changed in the transient period, the dynamic friction applied to the throttle valve is temporarily enlarged. The friction is predetermined as the threshold value of the opening of the throttle valve on the base of the intake air amount $Q_A$, intake tube pressure $P_B$ or $\Delta Q_A$ and $\Delta P_B$. Thus, when the stored throttle opening exceeds this threshold value, the drive torque of the throttle valve is increased, which makes it possible to ensure the drive of the throttle valve for preventing the out-of-phase.

Further, in the embodiment described above, the present stored throttle opening SM is compared with the specified value CNG; however, the target throttle opening $\theta_{AP}$ calculated according to the step-in angle of the accelerator 12 detected by the accelerator sensor 13, and its control procedure is the same manner as described above.

Figure 6:
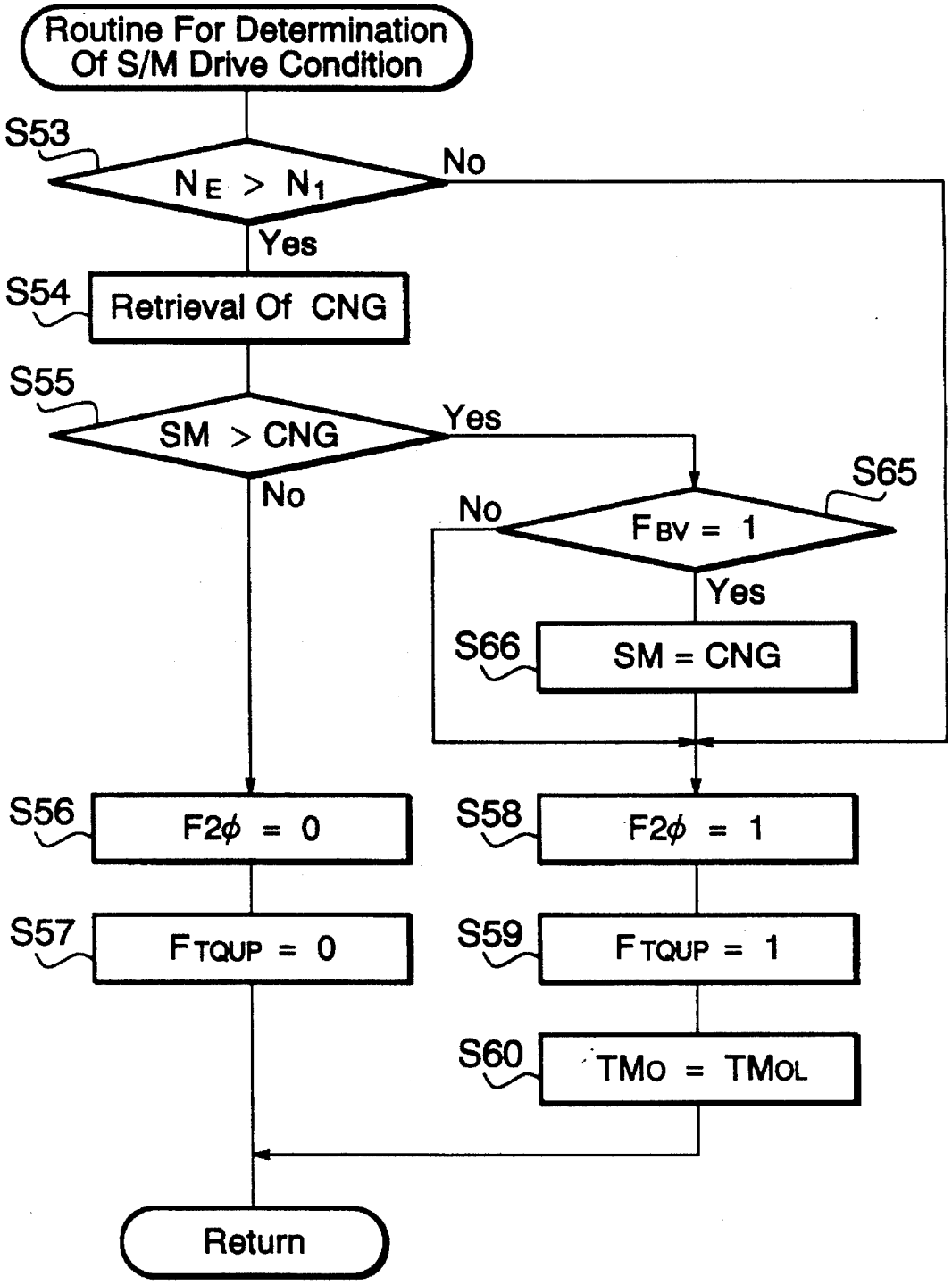
FIG. 6 is a flow chart showing a routine for determining a step-motor drive condition according to another embodiment.

Next, the example of taking a measure for the reduction in the battery voltage is shown in the flow-chart in FIG. 6.

FIG. 6 is the same as the flow-chart of the routine for determining the step-motor drive condition shown in FIG. 3 in the extent from the step 41 to the step 52, and therefore, these steps are omitted, and shows the steps 53 to 60. Namely, the steps 65 and 66 are inserted in the process from the step 55 to the step 58.

In the step 55, it is judged that the stored throttle opening SM exceeds the specified value CNG, the process advances to the step 65, wherein it is judged that a battery voltage flag $F_{BV}$ is either [0] or [1].

The battery voltage flag $F_{BV}$ is set at [1] when the above voltage sensor detects the reduction in the battery voltage, and is set at [0] when the battery keeps the specified voltage.

Accordingly, when $F_{BV}$ is judged to be [0] in the step 65, the process is jumped over the step 66 to the step 58. When $F_{BV}$=1, the process advances to the step 66 wherein the stored throttle opening SM is set at the specified value CNG as the threshold value for prohibiting the high opening, and the process advances to the step 58.

Namely, even in the case that the stored throttle opening SM exceeds the specified value CNG and the transient friction is possibly generated, when the battery voltage is lowered, the stored throttle opening SM is suppressed at the specified value CNG for prohibiting the high opening. Consequently, when the torque is reduced due to the reduction of the voltage applied to the step-motor 15, it is possible to obtain the certain drive without any out-of-phase.

According to the present invention, when the parameter showing the opening of the throttle valve exceeds the specified value, the drive torque of the throttle valve for preventing the out-of-phase due to the change of the load applied to the throttle valve in the transient period, thus making it possible to ensure the certain drive of the throttle valve.

Since the step-motor is not driven with the torque corresponding to the change in the load in the transient period, current consumption is not increased and responsiveness is not reduced.

When the voltage applied to the step-motor is reduced, the drive liable to cause the large opening of the throttle valve is prohibited, which makes it possible to certainly drive the throttle valve.

What is claimed is:

1. In an apparatus of controlling an intake air throttle valve in an internal combustion engine, comprising:

a throttle valve for controlling an intake air amount in said internal combustion engine;

a motor for electrically controlling said throttle valve; and a drive circuit for controlling the drive torque of said motor;

the improvement comprising:

a throttle valve opening defining means for defining a parameter indicating the opening of said throttle valve;

a comparing means for comparing the value of said parameter defined by said throttle valve opening defining means with a specified value; and a torque increasing means for increasing the output torque by said drive circuit when said comparing means judged that the value of said parameter is larger than said specified value.

2. An apparatus of controlling an intake air throttle valve in an internal combustion engine defined in claim 1, wherein said specified value is a variable changed on the small opening side according to the rotational number of said internal combustion engine when said rotational number is low.

3. An apparatus of controlling an intake air throttle valve in an internal combustion engine defined in claim 1, wherein said specified value is a variable changed according to at least one of the intake air amount and intake air tube pressure in said internal combustion engine.

4. An apparatus of controlling an intake air throttle valve in an internal combustion engine defined in claim 1, wherein said motor is a step-motor, and said parameter defined by said throttle valve opening defining means is a stored throttle valve opening for storing the present position of said step motor.

5. An apparatus of controlling an intake air throttle valve in an internal combustion engine defined in claim 1, which further includes an accelerator opening sensor, and said parameter defined by said throttle valve opening defining means is a target throttle valve opening according to the detection value by said accelerator opening sensor.

6. In an apparatus of controlling an intake air throttle valve in an internal combustion engine, comprising:

a throttle valve for controlling an intake air amount in said internal combustion engine;

a motor for electrically controlling said throttle valve; and a drive circuit for controlling the drive torque of said motor;

the improvement comprising;

a throttle valve opening defining means for defining a parameter indicating the opening of said throttle valve;

a voltage detecting means for detecting a voltage applied to said motor;

a comparing means for comparing the value of said parameter defined by said throttle valve opening defining means with a specified value; and a high opening drive prohibiting means for prohibiting the drive control of said throttle valve to be an opening larger than said specified value, in the case that said comparing means judges that the value of said parameter is larger than said specified value, when said voltage detecting means detects the reduction in the voltage applied to said motor.

* * * * *